US006705361B2

(12) United States Patent
Niederquell et al.

(10) Patent No.: US 6,705,361 B2
(45) Date of Patent: Mar. 16, 2004

(54) APPARATUS AND METHOD FOR FILLING A PAINTING ROBOT CANISTER

(75) Inventors: Bradley O. Niederquell, Troy, MI (US); Derrick McCaig, Oxford, MI (US); Stan H. McClosky, Rochester Hills, MI (US)

(73) Assignee: Fanuc Robotics North America, Inc., Rochester Hills, MI (US)

( * ) Notice: Subject to any disclaimer, the term of this patent is extended or adjusted under 35 U.S.C. 154(b) by 0 days.

(21) Appl. No.: 10/300,466

(22) Filed: Nov. 20, 2002

(65) Prior Publication Data

US 2003/0094211 A1 May 22, 2003

Related U.S. Application Data

(60) Provisional application No. 60/331,968, filed on Nov. 21, 2001.

(51) Int. Cl.[7] ..... B05B 5/00

(52) U.S. Cl. ..... 141/198; 141/2; 141/26; 141/27; 141/18; 141/83; 141/95; 141/192

(58) Field of Search ..... 141/2, 18, 21, 141/25, 26, 27, 83, 94, 95

(56) References Cited

U.S. PATENT DOCUMENTS

| | | | | |
|---|---|---|---|---|
| 3,906,122 A | | 9/1975 | Krause et al. | |
| 4,017,029 A | | 4/1977 | Walberg | |
| 4,313,475 A | | 2/1982 | Wiggins | |
| 4,680,958 A | * | 7/1987 | Ruelle et al. | 73/54.14 |
| 4,755,638 A | * | 7/1988 | Geberth, Jr. | 200/82 R |
| 4,761,120 A | * | 8/1988 | Mayer et al. | 417/403 |
| 4,771,729 A | | 9/1988 | Planert et al. | |
| 4,795,306 A | * | 1/1989 | Allan et al. | 414/744.8 |
| 5,100,690 A | | 3/1992 | Planert et al. | |
| 5,288,029 A | | 2/1994 | Ishibashi et al. | |
| 5,299,919 A | * | 4/1994 | Paul et al. | 417/387 |
| 5,310,120 A | | 5/1994 | Ehinger et al. | |
| 5,772,125 A | | 6/1998 | Ehinger et al. | |
| 6,325,244 B2 | * | 12/2001 | Vincent et al. | 222/1 |

FOREIGN PATENT DOCUMENTS

| | | |
|---|---|---|
| GB | 1 393 333 | 5/1975 |

* cited by examiner

*Primary Examiner*—J. Casimer Jacyna
(74) *Attorney, Agent, or Firm*—MacMillan, Sobanski & Todd, LLC

(57) ABSTRACT

An apparatus and a method for controlling a paint canister filling operation includes a controller for determining a total volume of paint required for a painting operation, calculating a required piston position and actuating a motor to move a piston in the interior of the canister to the required position. The controller opens a supply valve connected between the canister interior and a paint supply to fill the canister and monitors the torque applied by the motor to maintain the piston at the required position. When the torque exceeds a set point representing the torque value required to maintain the piston at the required position when the total required paint is in the canister interior, the controller closes the supply valve.

16 Claims, 3 Drawing Sheets

APPARATUS AND METHOD FOR FILLING A PAINTING ROBOT CANISTER

CROSS-REFERENCE TO RELATED APPLICATION

This application claims the benefit of U.S. provisional patent application serial no. 60/331,968 filed Nov. 21, 2001.

BACKGROUND OF THE INVENTION

The present invention relates generally to automated spray painting or coating equipment and, in particular, to an apparatus for controlling a paint canister filling operation.

In spray painting of various types of products, such as automobile bodies or automobile body panels, automated machinery has been developed to spray a succession of products in a continuous and rapid manner. One type of prior art spray painting device includes a canister that is adapted to be releasably attached to a robot arm. When the canister is empty, or when a change in paint color is required, the robot moves the canister to a docking station where the canister is exchanged for a full canister. While the robot is using paint from the full canister, the empty canister is being filled for the next job at the docking station.

The canisters include a piston slidably disposed therein whereby the position of the piston defines a desired volume required for "filling" the paint canister. A first step in the filling operation is to extend the piston so that no paint remains in the canister. A supply valve is opened and paint under pressure from a paint supply forces the paint into the canister, which paint displaces the piston within the canister. One prior art method of determining the amount of paint in the canister is to monitor the flow of paint to the canister with a flow monitoring instrument. Another method is to monitor the position of the piston with a sensor, such as a potentiometer, which provides an analog signal to a paint supply control. When the control detects that the piston has moved to the position that represents the desired volume of paint in the canister, the supply valve is closed and the paint filling operation is complete. The filled canister is now ready to be exchanged when the robot returns to the docking station. Alternatively, an encoder, rather than the potentiometer, can be used to detect when the piston is at the desired position.

The sensor, whether the potentiometer or the encoder, however is a potential source for electrical and/or mechanical failure. In addition, the sensor must be made intrinsically safe or explosion proof as it must operate in hazardous environments, such as a paint booth or the like.

It is desirable, therefore, to provide a method and an apparatus for monitoring a paint filling operation that reduces the risk of failure and does not require intrinsically safe or explosion proof construction in order for the apparatus to operate.

SUMMARY OF THE INVENTION

The present invention concerns a method and an apparatus for monitoring a paint canister filling operation. The apparatus includes a paint canister having a paint receiving interior with a piston slidably movable therein. A position of the piston in the canister interior determines a selected amount of paint to be received by the canister. The canister interior is connected to a paint supply through a supply valve. An actuator is connected to the piston for applying a force to the piston, which tends to move the piston in the canister interior. A sensor is connected to the actuator for sensing a force applied by the actuator to the piston. A control means is connected to the supply valve, the actuator and the sensor. The control means operates the actuator to move the piston to and maintain the piston at a predetermined position in the canister interior and opens the supply valve to cause paint to flow into the canister interior. The control means is responsive to a signal generated by the sensor representing a force applied by the actuator to maintain the piston at the predetermined position to close the supply valve when the force applied indicates a selected amount of the paint has been received by the canister. Preferably, the actuator is an electric motor and the sensor senses a value of torque generated by the electric motor representing said force applied to the piston.

The method for controlling a volume of paint in a canister during a filling operation according to the present invention, the canister including a piston movable in an interior of the canister, comprises the steps of: applying a force to a piston to move the piston to a predetermined required position in an interior of a canister corresponding to a total volume of paint required for a painting operation; supplying paint to the canister interior; applying a force to the actuator to maintain the piston in the required position; comparing the force being applied to the piston to a set point force representing the force required to maintain the piston at the required position; and stopping the supply of paint to the canister interior when the force being applied to the piston exceeds the set point force. The method can include, prior to performing said step a., moving the piston to an extended position to expel any paint in the canister interior, determining the total volume of paint required and calculating the required position for the piston.

The present invention advantageously provides efficiency to the paint filling process by determining when sufficient material has entered the canister. In the prior art, the control software waits for predetermined time interval. When the time interval expires, the assumption would be that all the material has been loaded into the canister.

The present invention eliminates this assumption by providing confirmation that material has entered the canister by the motor torque achieving the specified threshold torque value. The present invention also advantageously provides a means for air contamination detection by monitoring the rate of change of torque. Paint contaminated with air will be more compressible and, therefore, will have a slower increase of observed torque.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
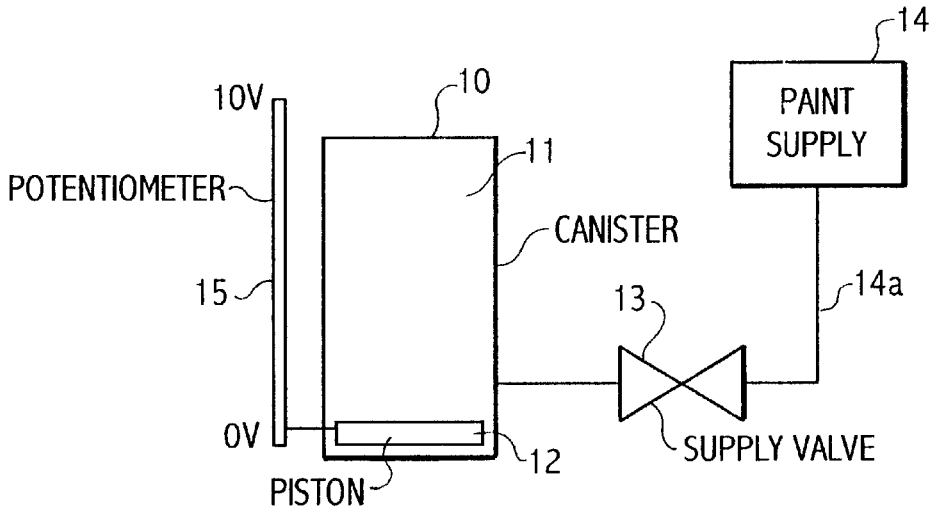
FIG. 1 (PRIOR ART)
FIG. 1 is a schematic view of a prior art apparatus for controlling the filling of a canister for a painting robot with a piston extended.
Figure 2:
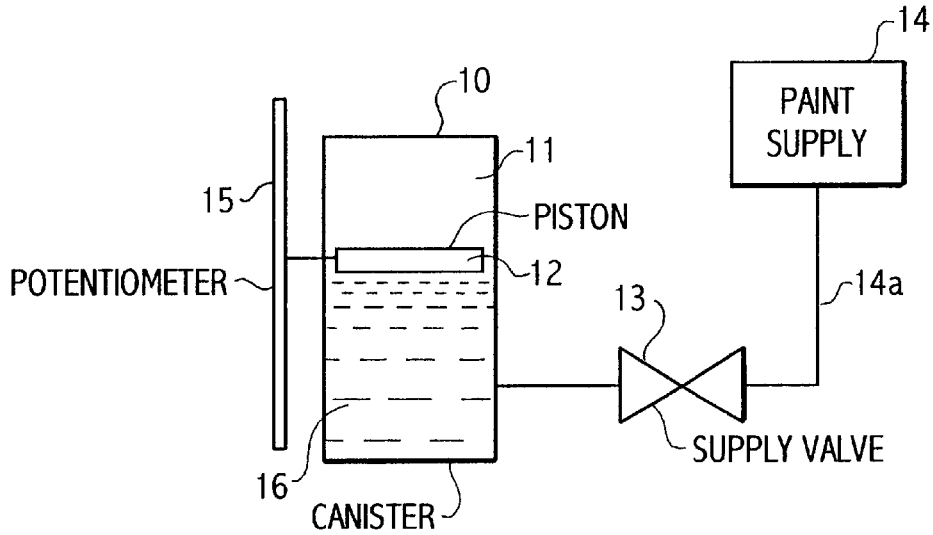
FIG. 2 (PRIOR ART)
FIG. 2 is a schematic view of the prior art apparatus shown in FIG. 1 with the piston in a predetermined paint volume filled position.

Referring to FIGS. 1 and 2, there is shown a prior art paint canister 10 having a generally hollow interior 11 in which a piston 12 is slidably moveable. The interior 11 is connected through a paint supply valve 13 to a paint supply 14 by a paint supply conduit 14*a*. The piston 12 is coupled to a potentiometer 15 that, in cooperation with a power supply (not shown), generates an electrical signal representing a position of the piston 12 in the canister interior 11. For example, the potentiometer 15 can generate a zero volt d.c. signal when the piston 12 is in a fully extended position shown in FIG. 1 wherein no paint is present in the canister interior 11 and generate a ten volt d.c. signal when the piston is fully retracted. In FIG. 2, the piston 12 is shown in a partially retracted position wherein a predetermined volume of paint 16 has entered the canister interior 11 through the supply valve 13 that has been opened to permit paint under pressure to flow from the paint supply 14 through the conduit 14*a* to the canister 10. The potentiometer 15 will generate a signal between zero volts and ten volts representing the position of the piston 12 as it moves from the fully extended position shown in FIG. 1 to the position shown in FIG. 2 whereupon the valve 13 is closed. However, the potentiometer 15 is susceptible to mechanical and electrical failures that require a robotic painting operation to be shut down.

Figure 3:
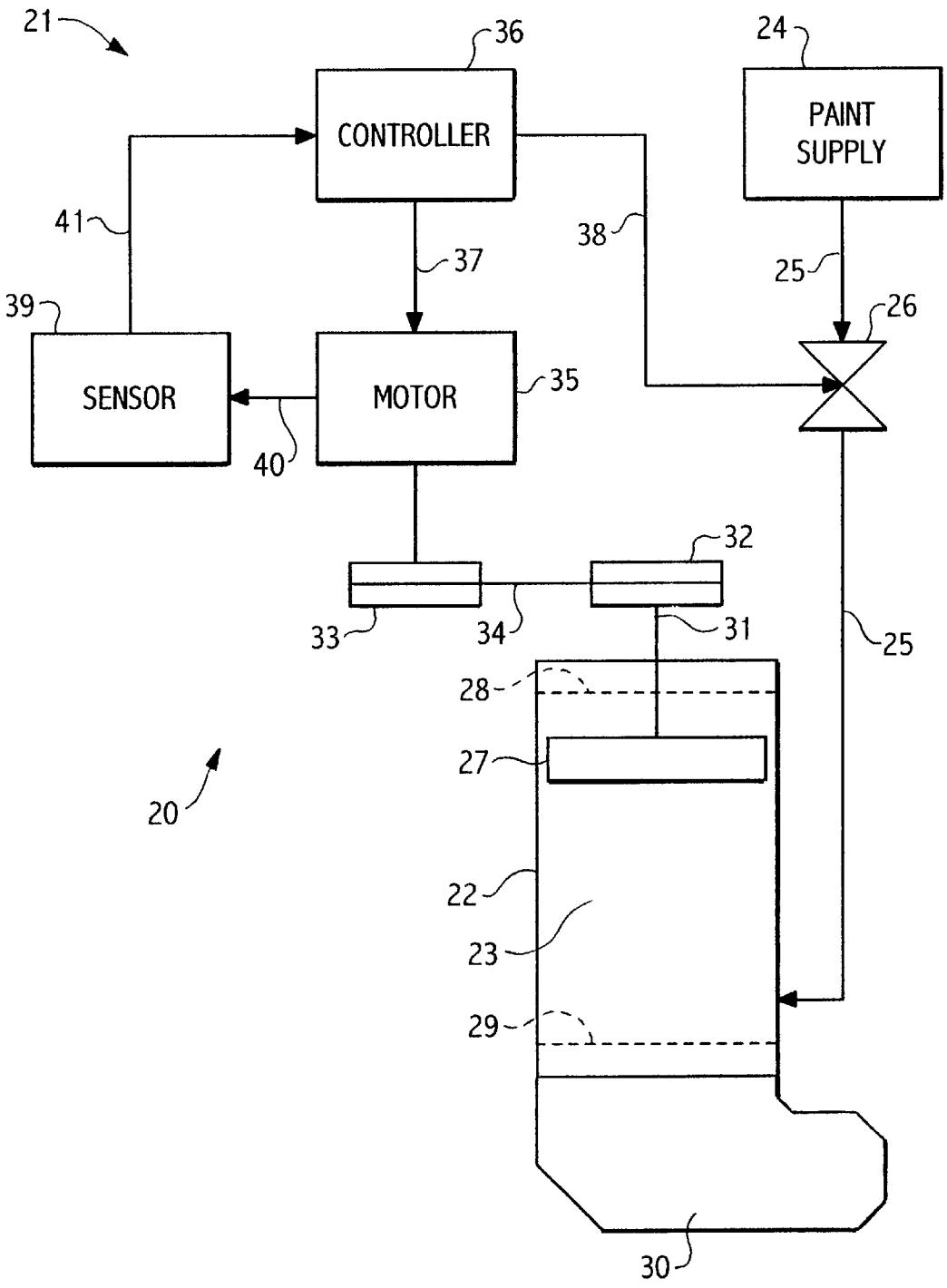
FIG. 3 is a schematic view of the apparatus for controlling the filling of a canister for a painting robot in accordance with the present invention.

Referring now to FIG. 3, there is shown a robotic painting system 20 including an apparatus 21 for controlling the filling of a paint canister 22 with a desired volume of paint in accordance with the present invention. The generally hollow paint canister 22 defines a canister interior 23 connected at one end to a paint supply 24 via a paint supply conduit 25. The flow of paint from the paint supply 24 to the canister 22 is controlled by a supply valve 26 connected in series in the conduit 25. A piston 27 is slidably disposed in the canister interior 23 and is operable to move between a fully retracted position 28 and a fully extended position 29. As the piston 20 moves toward the fully extended position 29, paint in the canister 22 is forced into a spray apparatus 30 to be applied to a product (not shown).

The piston 27 is moved in the canister 22 by a suitable actuator. For example, the piston 27 is connected to a ball screw 31 driven in rotation by a first pulley 32 mounted on a shaft of the ball screw. The pulley 32 is coupled to a second pulley 33 by a timing belt 34. The second pulley 33 is mounted on a shaft of an electric motor 35 that is operated to rotate the second pulley 33 to actuate the ball screw 31 thereby moving the piston 27 in the canister interior 23. The operation of the motor 35 is controlled by a control means such as a controller 36 connected to the motor by a motor control line 37. The controller 35 generates motor control signals at an output connected to the line 37 which signals can be in the form of electrical power to operate the motor 35 if the controller includes a power switching circuit. Alternatively, the motor 35 can include a power switching circuit such that the controller 36 generates the motor control signals required to operate the switching circuit.

The controller 36 also generates a valve control signal at an output connected to the valve 26 by a valve control line 38 to open and close the valve. A torque sensor 39 has an input connected to the motor 35 by a torque sensing line 40 to sense the torque generated by the motor. The sensor 39 has an output connected to an input of the controller 36 by a torque signal line 41 to generate a torque value signal to the controller. During a paint filling operation, the controller 36 compares the torque value signal with a predetermined set point value and closes the valve 26 when the predetermined value is exceeded. Typically, the torque sensor 39 senses the value of the motor armature current, which current is proportional to the torque being generated by the motor 35.

Figure 4:
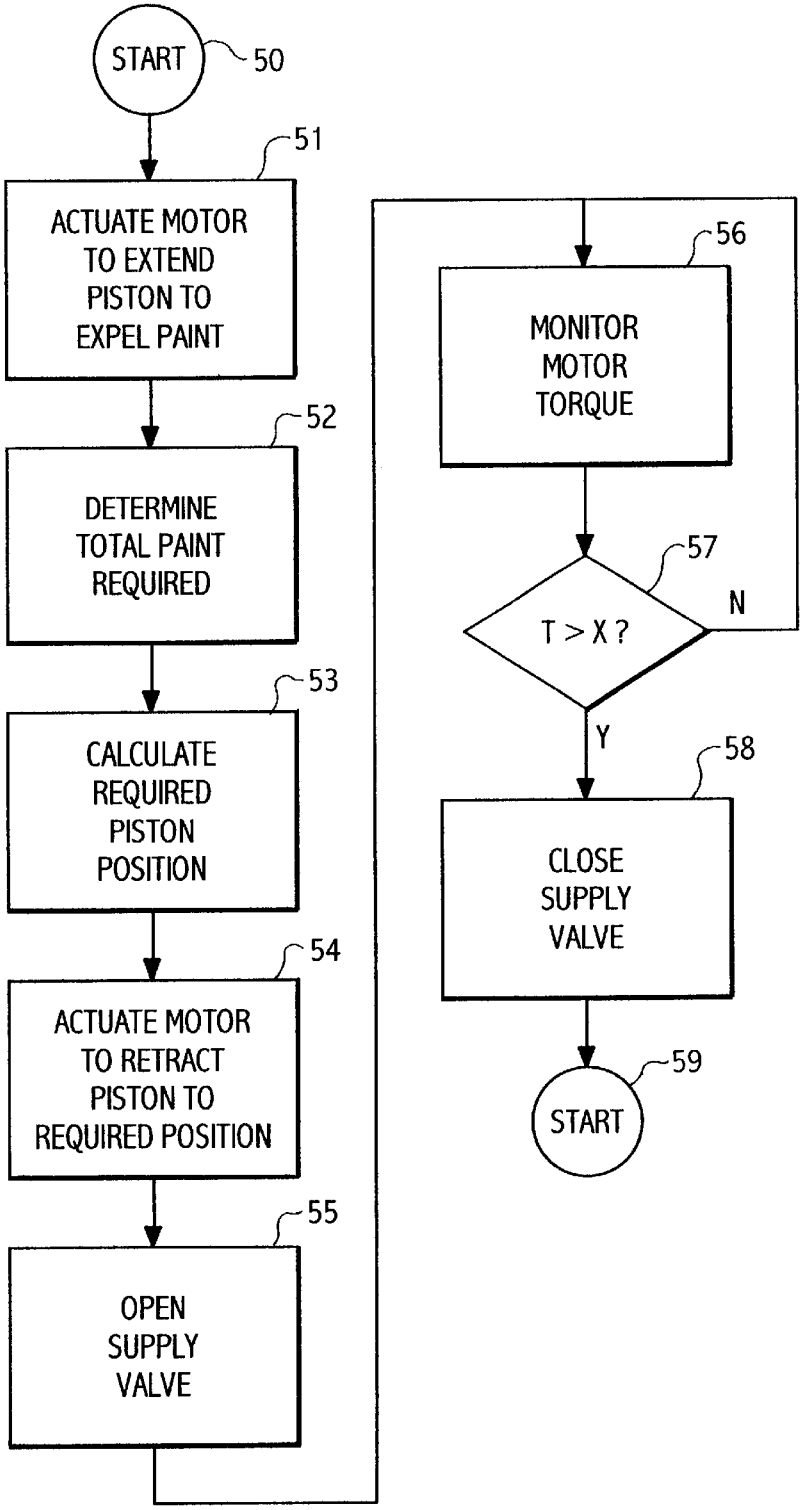
FIG. 4 is a flow diagram of the method of filling the canister in accordance with the present invention.

The control means, the controller 36, typically can be a programmable logic controller or a programmed computer. The control means includes a software program for implementing a method of performing a paint canister filling operation according to the present invention as shown in FIG. 4. Prior to the start of the filling operation, the controller 36 had closed the valve 26 at the end of the previous filling operation. The method begins at a circle 50 START and enters an instruction set 51 wherein the controller 36 sends a signal on the line 37 to actuate the motor 35 to extend the piston 27 to the extended position 29 thereby expelling the paint remaining in the interior 23 of the canister 22. The method then performs a step in an instruction set 52 wherein the controller 36 determines the total amount of paint required for the next painting job. In an instruction set 53, the controller 36 calculates the position of the piston 27 in the canister 22 required to provide the correct volume of the canister interior 23 to hold the total paint required as determined in the step 52. Now the method enters an instruction set 54 to generate the motor control signal on the line 38 to actuate the motor 35 to retract the piston 27 from the extended position 29 to the required position.

The canister 22 is ready to receive the total paint required. According to an instruction set 55, the controller 36 sends a signal on the line 38 to open the valve 26 allowing pressured paint to flow from the paint supply 24 to the canister interior 23 through the paint supply conduit 25. In an instruction set 56, the controller 36 monitors the torque signal from the torque sensor 39. As paint flows into the canister interior 23, the paint will exert a force on the piston 27 tending to push the piston away from the required piston position toward the retracted position 28. In order to maintain the piston 27 at the required piston position, the motor 35 must apply increasing amounts of torque to counteract the increasing volume of paint. In a decision point 57, the controller compares the sensed torque value "T" with a set point value "X" corresponding to the torque required to maintain the piston 27 at the required position when the canister 22 is filled with the total paint required.

If the set point has not been reached, the method branches from the decision point 57 at "N" and returns to the instruction set 56 to continue to monitor the motor torque. When the monitored torque value exceeds the set point value, the method branches from the decision point 57 at "Y" to an instruction set 58 wherein the controller 36 sends a signal on the line 38 to close the supply valve 26 and stop the paint from entering the canister interior 23. The canister filling operation is complete at a circle 59 END.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for monitoring a paint canister filling operation, the paint canister being connected to a paint source through a supply valve and including a piston movable in an interior of the canister, the piston being connected to an actuator for applying a force to move the piston, comprising:

a sensor adapted to be connected to the actuator for sensing a force applied by the actuator to the piston; and a control means adapted to be connected to the supply valve, to the actuator and to said sensor whereby said sensor is connected to the actuator and said control means is connected to the supply valve, to the actuator and to said sensor, said control means selectively operates the actuator to move the piston to and maintain the piston at a predetermined position in the canister interior representing a total amount of paint required for a painting operation, said control means selectively opens the supply valve to cause paint to flow into the canister interior, and said control means is responsive to a signal generated by said sensor representing a force applied by the actuator to maintain the piston at said predetermined position for closing the supply valve when said force signal represents that said total amount of paint required has been received by the canister.

2. The apparatus according to claim 1 wherein the actuator is an electric motor and said sensor is a torque sensor for sensing a value of torque generated by the electric motor as representing said force applied to the piston.

3. The apparatus according to claim 1 wherein the actuator is an electric motor and said sensor is a current sensor for sensing a current flowing in an armature of the electric motor as representing said force applied to the piston.

4. An apparatus for monitoring a paint canister filling operation comprising:

a paint canister having a paint receiving interior with a piston slidably movable therein, a position of said piston in said canister interior limiting an amount of paint to be received by the canister, said canister interior being connected to a paint supply through a supply valve;

an actuator connected to said piston for applying a force to said piston tending to move said piston in said canister interior;

a sensor connected to said actuator for sensing a force applied by said actuator to said piston; and a control means connected to said supply valve, to said actuator and to said sensor, said control means selectively operating said actuator to move said piston to and maintain said piston at a predetermined position in said canister interior representing a total amount of paint required for a painting operation, said control means selectively opening said supply valve to cause paint to flow into said canister interior, and said control means being responsive to a signal generated by said sensor representing a force applied by said actuator to maintain said piston at said predetermined position for closing said supply valve when said force signal represents that said total amount of paint required has been received by said canister.

5. The apparatus according to claim 4 wherein said actuator is an electric motor and said sensor is a torque sensor for sensing a value of torque generated by said electric motor as representing said force applied to said piston.

6. The apparatus according to claim 4 wherein said actuator is an electric motor and said sensor is a current sensor for sensing a current flowing in an armature of said electric motor as representing said force applied to said piston.

7. The apparatus according to claim 4 wherein said actuator is connected to said piston by a ball screw.

8. The apparatus according to claim 7 wherein said actuator is an electric motor coupled to said ball screw by a belt.

9. The apparatus according to claim 4 wherein said control means is one of a programmable logic controller and a programmed computer.

10. A method for controlling a volume of paint in a canister during a filling operation, the canister including a piston movable in an interior of the canister, comprising the steps of:

a. applying a force to a piston to move the piston to a predetermined required position in an interior of a canister corresponding to a total volume of paint required for a painting operation;

b. supplying paint to the canister interior;

c. applying a force to the actuator to maintain the piston in the required position;

d. comparing the force being applied to the piston to a set point force representing the force required to maintain the piston at the required position; and e. stopping the supply of paint to the canister interior when the force being applied to the piston exceeds the set point force.

11. The method according to claim 10 including prior to performing said step a., moving the piston to an extended position to expel any paint in the canister interior.

12. The method according to claim 10 including prior to performing said step a., determining the total volume of paint required.

13. The method according to claim 10 including prior to performing said step a., calculating the required position for the piston.

14. The method according to claim 10 wherein said step b. is performed by opening a supply valve connected between the canister interior and a paint supply and said step e. is performed by closing the supply valve.

15. The method according to claim 10 wherein said step c. is performed by operating an electric motor connected to the piston by a ball screw.

16. The method according to claim 15 wherein said step d. is performed by sensing an armature current flowing in said electric motor and comparing a value of the armature current with a value of the set point.

* * * * *